United States Patent [19]

Jackson

[11] 4,387,838

[45] Jun. 14, 1983

[54] GLOVE-MOUNTED WRIST WATCH

[76] Inventor: Patrick L. Jackson, 4211 Forest Rd., St. Louis Park, Minn. 55416

[21] Appl. No.: 303,201

[22] Filed: Sep. 18, 1981

[51] Int. Cl.[3] ..... A44C 5/14; A41D 19/00

[52] U.S. Cl. ..... 224/170; 2/160

[58] Field of Search ..... 224/152, 164, 168, 170, 224/171, 173, 182; 2/160, 161

[56] References Cited

U.S. PATENT DOCUMENTS

| | | | |
|---|---|---|---|
| 1,416,654 | 5/1922 | Lenneberg | 2/160 |
| 1,524,137 | 1/1925 | Kastl et al. | 2/160 |
| 2,103,711 | 12/1937 | Cole | 2/160 |

*Primary Examiner*—Steven M. Pollard
*Assistant Examiner*—D. Voorhees
*Attorney, Agent, or Firm*—Orrin M. Haugen; Thomas J. Nikolai

[57] ABSTRACT

A glove-mounted watch comprising in combination a glove including a wrist portion having a wrist-watch receiving area, a pair of spaced members secured to the outer surface of the wrist portion at opposite sides of the area for receiving the telescopic bracelet pins of a wrist watch, so as to secure a wrist watch in the area, a flap, having a central observation aperture smaller than the face of a wrist watch, secured to the wrist portion to fold over a wrist watch secured in the area, so that the observation aperture may become aligned with the area to enable observation of a watch therein, a first plurality of strips of resilient material is secured to the wrist portion to abut the area, a second plurality of strips of resilient material secured to the inside of the flap to engage the strips of the first plurality when the flap is folded, for closely surrounding a watch in the area, the combined thickness of the strips being less than the thickness of a watch so that when the flap is folded, the rim of the aperture may engage the face of a watch in the area to prevent the passage of undesired matter into the area, the flap being removably secured in folded position over the area.

7 Claims, 3 Drawing Figures

GLOVE-MOUNTED WRIST WATCH

TECHNICAL FIELD

This invention relates to the field of horology, and particularly to an arrangement for mounting a wrist watch so that it can be conveniently observed by a skier and yet be protected from damage in the skiing ambience.

BACKGROUND OF THE INVENTION

Wrist watches are very convenient means for telling time, but there are circumstances under which a wrist watch must be protected from the inclemencies of the environment. It is known to provide a glove with a flap which may be opened to expose a wrist watch worn beneath the glove on the user's wrist. It is also known to form a glove with an outwardly opening pocket within which a "pocket" watch is clipped or otherwise secured, for continuous exposure of its face, or for protection by a displaceable flap. None of these arrangements is practical for use by sportsmen such as skiers.

SUMMARY OF THE INVENTION

The present invention is a glove construction in which a wrist watch is secured by the telescopic bracelet pins normally provided, is protected from the elements and from mechanical injury, and yet is continuously observable.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
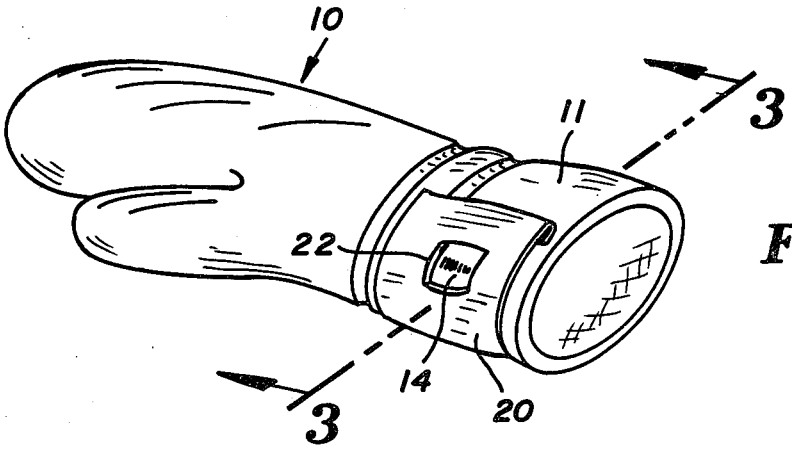
FIG. 1 is a view in perspective of a skier's glove embodying a wrist watch according to the invention.
Figure 2:
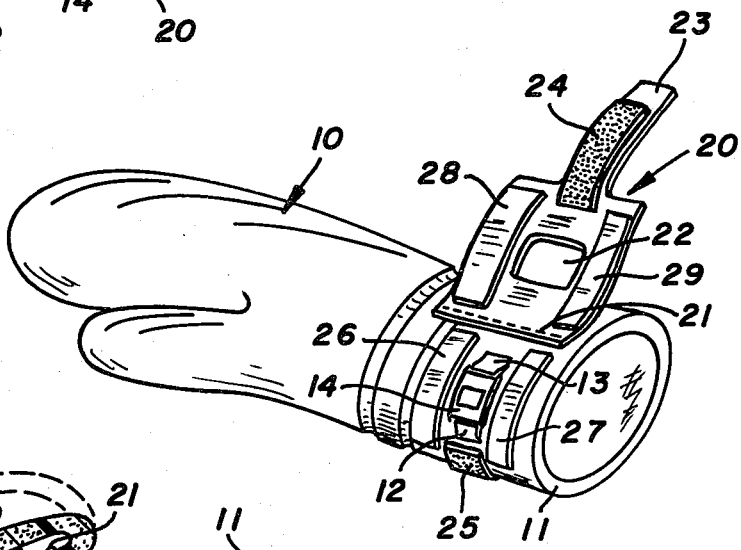
FIG. 2 is a similar view showing how access to the watch is afforded when necessary.
Figure 3:
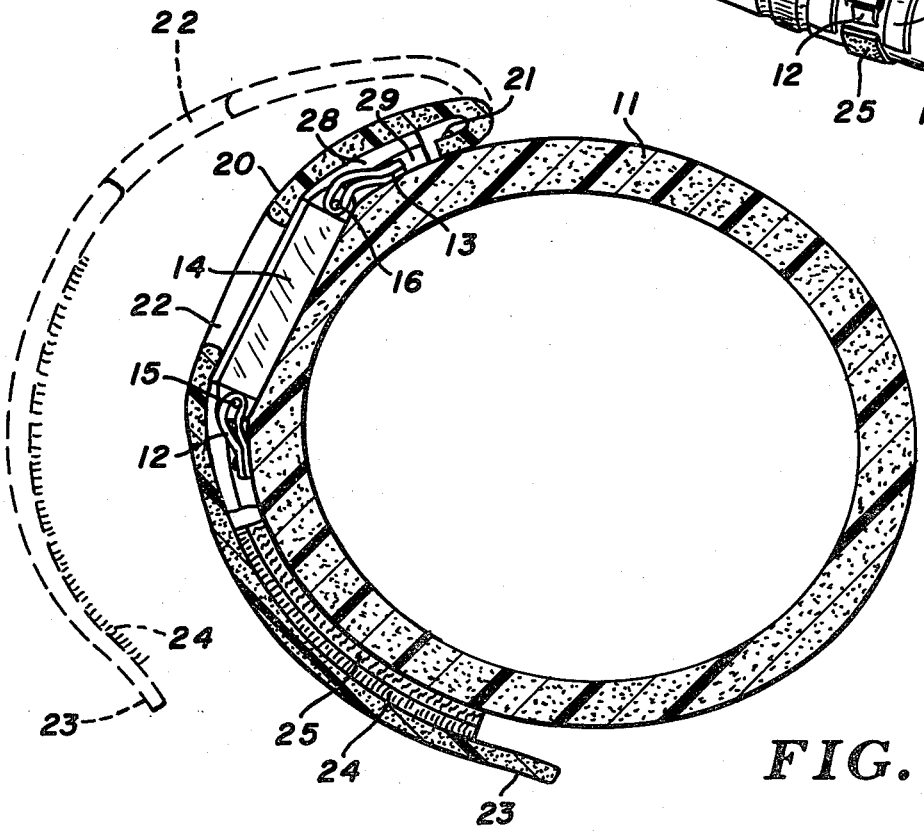
FIG. 3 is a view to a larger scale, in section generally along the line 3—3 of FIG. 1.

A skier's glove 10 is shown in the drawing to include a wrist portion 11 to which there are secured by any suitable means, as by sewing, a pair of loop members 12 and 13. A wrist watch 14 is secured to wrist portion 11 by the usual telescopic pins 15 and 16 passing through members 12 and 13 into the holes provided therefor in the frame of the watch.

A flap 20 is secured to wrist portion 11, as by sewing 21, and has a central aperture 22 through which the face of the watch may be observed. Flap 20 includes a tab 23 carrying on its inner surface a strip 24 of Velcro hook material, and a strip 25 of Velcro loop material is secured to wrist portion 11, to cooperate with strip 24 in retaining the flap in closed position to protect the watch. Strips 26 and 27 of resilient material on wrist portion 11, and similar strips 28 and 29 on flap 20 provide a protective enclosure about watch 14 and space flap 20 therefrom by approximately the thickness of the watch: if desired these strips may also be of Velcro hook and loop material.

The structure described provides an arrangement for mounting a wrist watch by the usual means, protecting it from the skiing environment, and yet keeping it readily visible. By being secured to the outer surface of the wrist portion of the glove instead of to the wearer's wrist, the watch quickly reaches a temperature near the ambient, and the tendency of snow to adhere to and melt on the face of the watch is greatly reduced. Flap 20 and strips 26-29 largely protect the watch from the impacts sometimes occurring.

From the foregoing, it is evident that the invention comprises a glove mounted timepiece, for use by sportsmen such as skiers, in which the watch is securely mounted and protected while remaining easily observable without any action by the wearer.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. In combination:

a garment including a gauntlet wrist portion having a wrist watch receiving area;

a pair of spaced members secured to the outer surface of said gauntlet at opposite sides of said area for receiving the telescopic bracelet pins of a wrist watch, whereby to secure a wrist watch in said area;

a flap, having a central observation aperture smaller than the face of a wrist watch, secured to said gauntlet to fold over a wrist watch, secured in said area by pins in said members, so that said observation aperture may become aligned with said area to enable observation of a watch therein;

a first plurality of strips of resilient material secured to said gauntlet to abut said area;

a second plurality of strips of resilient material secured to the inside of said flap to engage the strips of said first plurality when said flap is folded, for closely surrounding a watch in said area, the combined thickness of said straps being less than the thickness of a watch so that when said flap is folded, the rim of said aperture may engage the face of a watch in said area to prevent the passage of undesired matter into said area;

and further means secured to said gauntlet and said flap for holding said flap in folded position over said area.

2. The combination of claim 1 together with a wrist watch secured in said area by pins received in said spaced members.

3. The combination of claim 1 in which the strips of one of said pluralities are Velcro loops and the strips of the other plurality are Velcro hooks.

4. The combination of claim 1 in which said garment is a ski mitten of leather-like material and said flap is also of said material.

5. The combination of claim 1 in which said further means comprises mating strips of Velcro hook and Velcro loop material.

6. In combination:

a wrist watch having projections to receive the telescopic pins of a bracelet;

a garment having a gauntlet with a wrist watch receiving area;

a pair of spaced members secured to the outer surface of said gauntlet at opposite sides of said area, for receiving a pair of telescopic pins engaging said projections of said wrist watch to secure said watch in said area;

a flap having a central observation aperture of smaller size than the face of said wrist watch;

means securing said flap to said gauntlet to fold over said wrist watch in said area so that said observation aperture is aligned with the face of said watch to enable observation thereof;

means for securing said flap in folded position over said watch;

and resilient means carried in part by said gauntlet and in part by said flap, in close lateral abutting relation to said watch, the thickness of said resilient means being less than the thickness of said watch so that when said flap is folded, the rim of said aperture engages the face of said watch to prevent passage of undesired matter into said area.

7. The combination of claim 6 in which said resilient means comprises strips of Velcro hook and Velcro loop material.

* * * * *